United States Patent [19]

Weaver

[11] 4,171,800

[45] Oct. 23, 1979

[54] BENCH MOUNTED SUPPORT FOR JEWELRY ARTICLES AND THE LIKE

[75] Inventor: Earl R. Weaver, Dallas, Tex.

[73] Assignee: Swest, Inc., Dallas, Tex.

[21] Appl. No.: 934,852

[22] Filed: Aug. 18, 1978

[51] Int. Cl.[2] ..... B25B 5/04

[52] U.S. Cl. ..... 269/75; 81/4; 248/182; 269/97; 269/234

[58] Field of Search ..... 269/97, 234, 75; 81/4; 248/182

[56] References Cited

U.S. PATENT DOCUMENTS

| | | | |
|---|---|---|---|
| 941,832 | 11/1909 | Widmann | 81/4 |
| 2,681,783 | 6/1954 | Smith | 248/182 |
| 2,731,863 | 1/1956 | Bellows | 269/75 |
| 4,119,305 | 10/1978 | Anderson | 269/97 |

*Primary Examiner*—Robert C. Watson
*Attorney, Agent, or Firm*—Kenneth R. Glaser

[57] ABSTRACT

Disclosed is a work holder assembly for retaining jewelry articles, the work holder including a clamp assembly for clamping retention of the jewelry article, a bench mount assembly, and a gimbal-type connector coupling the clamp with the bench mount. The gimbal connector includes a ring assembly rotatably and hingedly connected with the bench mount and rotatably connected with the clamp. A filing block, interchangeable with the clamp assembly, is adapted for connection with the bench mount.

3 Claims, 4 Drawing Figures

FIG. 1
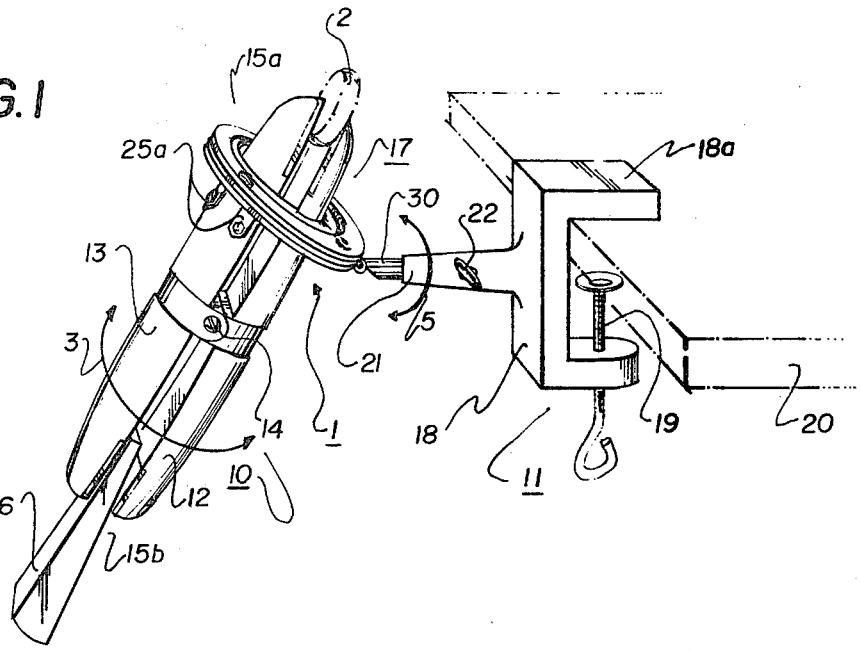
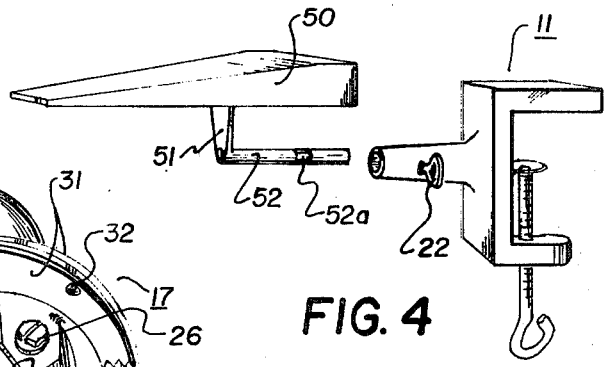
FIG. 4
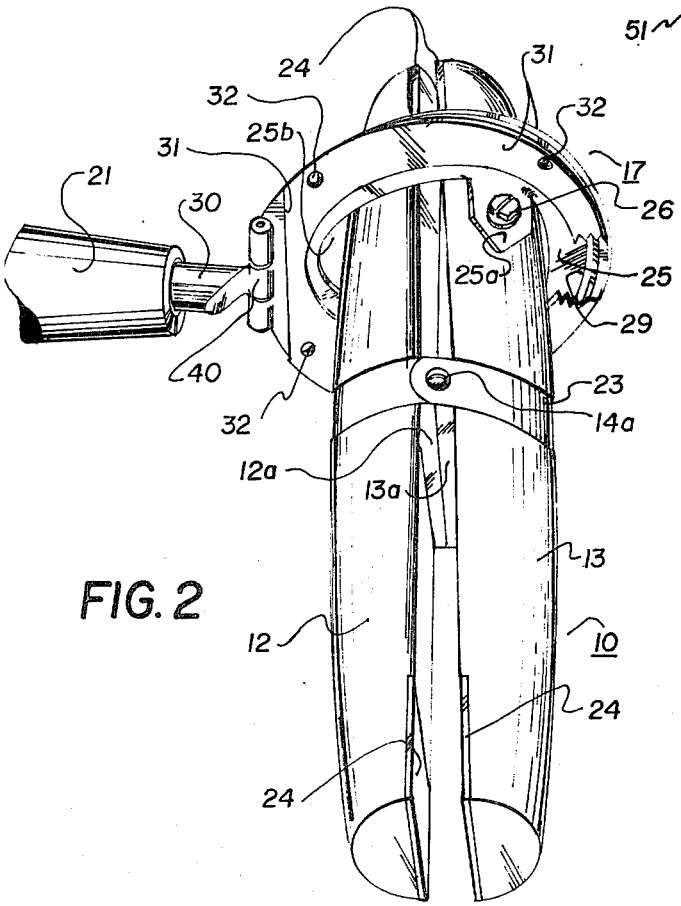
FIG. 2
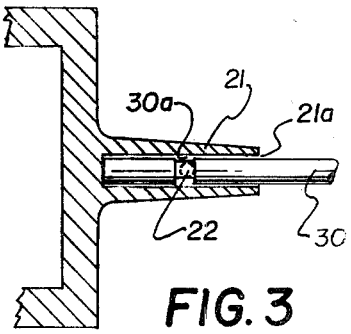
FIG. 3

BENCH MOUNTED SUPPORT FOR JEWELRY ARTICLES AND THE LIKE

This invention relates to work holders, more particularly to work holders of the type for clampingly retaining jewelry articles, and even more particularly to clamping type work holders adapted to be mounted to a work bench or other fixed structure.

In the jewelry trade, it is often necessary to perform numerous mechanical operations during the creation, modification, or repair of various types of jewelry articles. For example, in the setting of precious stones in rings, pendants, or the like, the jewelery carries out numerous steps of filing, carving, sawing, etc. in order to appropriately shape and prepare the setting for receipt of the stones. As a consequence, it is desirable, and often critical for the convenient and accurate working of such article, that the jeweler employ a work holder or vise which is capable of not only rigidly supporting the jewelry article being prepared, but which also is conveniently adjustable to position the work at virtually any desired orientation.

Prior to the design of the work holder of the present invention, it has been customary for jewelers to employ a clamping device comprising a pair of elongated opposed jaw members pivotally joined at an intermediate point between the ends thereof with a wedge-type device inserted between the jaws at one end to clamp the jaws at the opposite end against the ring or jewelry article to be worked. The principal disadvantage of such device is that it is basically a hand-held clamp which thus requires the jeweler to physically brace the clamp against the bench surface and then rely upon his own strength and dexterity to rigidly hold and position the clamped ring during the various mechanical operations.

There is presently known in the art various types of bench mounted clamps, for example the work holders disclosed in U.S. Pat. Nos. 157,189; 988,923; 2,586,636; 2,660,079; 2,731,863; and 3,947,010. While these work holders are generally suited for their intended purpose, they are either not suitable for use by the jeweler for the operations previously discussed or are not susceptible to a universal range of adjustments necessary to position the clamped article in the desired orientation.

It is therefore a principal object of the present invention to provide a new and improved work holder.

It is another object of the present invention to provide a new and improved device for clamping retention of a jewelry article or the like which enables an essentially universal orientation of the clamping device and article during use.

It is a still further object of the present invention to provide a new and improved means for coupling a jewelry article clamping device with a bench mount which enables complete rotation and universal angular orientation of the clamping device with respect to the bench mount.

In accordance with these and other objects, the present invention is directed to a work holder assembly for retaining a jewelry article or the like, the work holder comprising, in combination, a clamp sub-assembly defined by a pair of opposed, pivotally joined jaw members for retaining the particular jewelry article; a bench mount sub-assembly for rigid attachment to the bench surface; and a gimbal-type connector for coupling the clamp sub-assembly with the bench mount sub-assembly in a manner which enables complete rotation and virtually unlimited angular orientation of the work. In accordance with a preferred embodiment of the invention, the gimbal connector is provided by a ring assembly disposed around, and rotatably joined with, the clamp sub-assembly with a hinged shaft joining the ring assembly with the bench mount to enable additional degrees of freedom of movement of the entire clamp subassembly. In addition, a filing block, interchangeable with the clamp sub-assembly, is adapted for connection with the bench mount.

Specific features, as well as additional objects and advantages, of the invention will become more readily understood and appreciated by reference to the following detailed description taken in conjunction with the attached drawings, in which:

FIG. 1 is a pictorial view of the work holder assembly of the present invention, illustrating the interconnection of the clamp sub-assembly with the bench mount sub-assembly;

FIG. 2 is an enlarged pictorial view specifically illustrating the structural features and operation of the clamp and coupling ring assemblies of the work holder depicted in FIG. 1 with a portion of the ring assembly removed for convenience of viewing and description;

FIG. 3 is a view, partially in section, illustrating the interconnection of the ring assembly with the bench mount; and FIG. 4 is a pictorial view illustrating the interchangeability of the filing block and its relationship with the bench mount sub-assembly.

The drawings are not necessarily to scale and in some instances, portions have been exaggerated, in order to emphasize particular features of the invention.

Referring initially to FIG. 1, the improved vise or work holder assembly of the present invention is broadly depicted by the reference numeral 1 and comprises a clamp sub-assembly 10 in combination with, and adapted for coupling with, a bench mount sub-assembly 11 by way of a ring assembly 17. The clamp sub-assembly comprises a pair of opposed jaw members 12 and 13 pivotally joined at a location 14 intermediate the opposed ends **15*a* and 15*b* thereof. Thus, a jewelry article, such as a ring 2, can be inserted between the opposed jaws at the end 15*a* with the requisite clampimg force for holding the ring being provided as a consequence of the insertion of a wedge member 16 between the jaws at the opposite end 15*b*, all as depicted in FIG. 1**.

In accordance with a unique feature of the present invention, the ring assembly 17, the details and operation of which are subsequently described, is disposed around the jaws 12 and 13 of, and suitably connected with, the clamp sub-assembly 10 at the end **15*a* in a manner which enables full (360°) rotation of the pivotal jaw assembly (as indicated by the arrow 3). Additionally, the ring assembly 17 (and therefore the entire clamp sub-assembly 10) is adapted for coupling with the bench mount 11 by a gimbal connection which enables the clamp 10 to be angularly inclined, the ring assembly rotatably joined to the bench mount 11 by shaft 30. As a consequence, the clamp assembly 10 (and thus ring 2**) can be positioned in essentially any orientation desired.

The bench mount sub-assembly 11 includes a C-shaped clamp body 18 with clamp bolt 19 effective to clamp the body 18 to the edge of the bench 20, all as conventionally known. The upper portion **18*a*** of the clamp body is desirably formed with a flat surface so as to provide a convenient anvil surface for the workman.

A collar 21 extends from the clamp body 18 and defines a channel in which the shaft 30 is received (FIG. 3), a set or lock screw 22 being threadably received within a transverse opening in the collar 21 for rigidly retaining the shaft 30 at the desired rotatable position.

Referring now to FIG. 2, the jaws 12 and 13 of the clamp sub-assembly 10 are preferably constructed of wood and are of a semi-circular cross section with lips 12*a* and 13*a* extending in face-engaging relationship at a position intermediate their length. A metal band 23 disposed around the jaws and retained by pin 14*a* enables the pivotal movement of the jaw 12 with respect to jaw 13 about such location. Friction pads 24 are provided at the opposite ends of the jaw members to facilitate retention of the wedge 16 (at end 15*b*) and ring 2 (at end 15*a*).

The ring assembly 17 includes an inner annular-shaped metal plate 25 having dependent portions 25*a* secured, as by bolts 26, to one of the jaw members (in the illustration, jaw member 13). The plate 25 has an opening 25*b* of a size and shape for passage therethrough of the jaws 12 and 13 and to allow for the pivotal movement of the jaw 12 with respect to jaw 13.

The plate 25 is disposed, and free to rotate, within the confines of an annular-shaped channel 29 defined at the circumferential edge of an outer metal sleeve 31, as particularly depicted in FIG. 2. This annular sleeve may be formed by a plurality of superimposed ring-shaped elements secured, for example, by fasteners 32. As a consequence of this construction, the inner plate 25 (and consequently the entire clamp sub-assembly 10) can be rotated a full 360° with respect to the outer sleeve 31.

The ring assembly 17 also includes an elongated shaft 30 which is hingedly connected to the sleeve 31 by a T-hinge 40. The shaft 30 has a circular notch 30*a* which acts as a detent; thus, when the shaft 30 is inserted into the channel 21*a* defined by collar 21 (FIG. 3), the advancement of the set screw 22 into the detent 30*a* locks the shaft 30 (and therefore ring assembly 17) to the bench mount sub-assembly 11.

It is therefore apparent that the design of, and interrelationship between, the various sub-assemblies 10, 11, and 17 of the work holder of the present invention provide apparatus which conveniently and effectively retains and positions the jewelry article at essentially any desired orientation. Thus, when the work holder is assembled in the manner depicted in FIG. 1, the clamping assembly 10 may be rotated to any desired position (in either the clockwise or counter-clockwise direction of the arrow 3); may furthermore be inclined or tipped to any desired angular position as a consequence of the hinged connection 40; and may additionally be rotated (in the direction depicted by arrow 5) to the desired position within, and with respect to, the collar 21 upon the loosening and subsequent resetting of the set screw 22.

As an additional feature of the present invention, reference is now to FIG. 4 wherein a filing block defined by a wedge shaped body 50 is adapted to be coupled with the bench mount sub-assembly 11 by way of bracket 51 and shaft 52, a detent 52*a* enabling lockable retention of the shaft 52 within the channel 21*a* in the manner similar to that previously described. Thus, when the clamp sub-assembly 10 is not being utilized, it can be interchanged with the filing block for use by the jeweler.

Various modifications to and adaptations of the disclosed embodiments of the invention can be made by one skilled in the art without departing from the spirit and scope of the invention as defined by the appended claims.

What is claimed is:

1. A work holder assembly for retaining a jewelry article or the like, said assembly comprising:

(a) clamping means comprising a pair of elongated opposed jaw members pivotally joined so as to move into and out of clamping engagement with said jewelry article;

(b) bench mount means comprising a generally C-shaped body, a clamp bolt for clamping said body to a bench surface within the confines of said C-shaped body, and a collar transversely extending from said C-shaped body and defining a channel therein; and (c) gimbal connector means for coupling said clamping means with said bench mount means for enabling rotation and angular orientation of said clamping means with respect to said bench mount means, said gimbal connector means comprising a ring assembly defined by first and second ring means adapted for rotation with respect to one another, one of said ring means being rigidly attached to one of said jaw members; said ring assembly further comprising an elongated shaft adapted for rotatable connection within the channel of said collar.

2. The assembly as defined by claim 1 wherein said elongated shaft is hingedly connected with one of said ring members.

3. The assembly as defined by claim 2 further comprising means for restraining said shaft from rotation within said channel.

* * * * *